United States Patent [19]

Stull

[11] Patent Number: 5,072,863

[45] Date of Patent: Dec. 17, 1991

[54] PUSH-TO-OPEN NON-RESEALABLE CAP CONSTRUCTION

[76] Inventor: Gene Stull, 1086 Hacklebarney Rd., Chester Township, Morris County, N.J. 07930

[21] Appl. No.: 496,937

[22] Filed: Mar. 21, 1990

[51] Int. Cl.[5] ..... B67D 3/00

[52] U.S. Cl. ..... 222/523; 222/525; 215/263

[58] Field of Search ..... 222/519, 520, 521, 522, 222/523, 524, 525, 147; 215/206, 263

[56] References Cited

U.S. PATENT DOCUMENTS

| | | | |
|---|---|---|---|
| 1,095,922 | 5/1914 | Parry | 215/263 |
| 1,958,429 | 5/1934 | Hartog | 222/153 |
| 2,994,461 | 8/1961 | Michel | 222/153 |
| 3,145,011 | 8/1964 | Kappel | 251/349 |
| 3,325,064 | 6/1967 | Scheck | 222/402.14 |
| 3,351,249 | 11/1967 | Stull | 222/520 |
| 3,804,302 | 4/1974 | Yamada et al. | 222/182 |
| 4,277,004 | 7/1981 | Barlics | 222/402.14 |
| 4,424,918 | 1/1984 | Stull | 222/153 |
| 4,440,325 | 4/1984 | Treuhaft et al. | 222/402.14 |
| 4,511,050 | 4/1985 | Nicol | 215/206 |

FOREIGN PATENT DOCUMENTS

| | | | |
|---|---|---|---|
| 943452 | 12/1963 | United Kingdom | 222/521 |

*Primary Examiner*—Michael S. Huppert
*Assistant Examiner*—Gregory L. Huson
*Attorney, Agent, or Firm*—H. Gibner Lehmann; K. Gibner Lehmann

[57] ABSTRACT

A push-to-open, non-resealable cap construction for hand-held dispensers. The cap has a body member with a discharge passage, and a nozzle member carried by the body member and axially shiftable thereon between a raised, sealing position and a lowered, discharge position. There is a discharge orifice in the nozzle member. A valve structure on the members controls communication between the discharge passage and the discharge orifice to regulate product flow. A blocking rib on the nozzle member normally maintains it in the raised, sealing position in the absence of an external axial force, but the rib can be re-positioned by turning the nozzle member, which latter can then be shifted from its raised, sealing position to its lowered, discharge position. A detent structure on the body member and nozzle member thereafter serves to retain the latter in its lowered, discharge position once it has arrived there.

24 Claims, 1 Drawing Sheet

PUSH-TO-OPEN NON-RESEALABLE CAP CONSTRUCTION

BACKGROUND OF THE INVENTION

1. Field of the Invention

This invention relates generally to caps for hand-held dispensers, and more particularly to devices of the type which resist re-sealing, following initial use of the dispenser.

2. Description of the Related Art Including Information Disclosed Under 37 CFR §§1.97–1.99

My U.S. Pat. No. 4,424,918 illustrates one type of non-resealable cap construction involving a turnable twist cap which is carried on a cap body, and where there are interference shoulders on the inner surface of the twist cap and on the cap body, which by-pass one another when the twist cap is initially raised, and which prevent it from being subsequently re-seated.

Typical cap constructions of the twist-open or push-pull type are disclosed in U.S. Pat. No. 3,351,249 issued Nov. 7, 1967, to M. B. Stull, and entitled CAPTIVE DISPENSING CLOSURE FOR CONTAINERS; and U.S. Pat. No. 1,958,429 issued May 15, 1934, to P. Hartog, and entitled CLOSURE FOR TUBES AND LIKE CONTAINERS. Both of the patented devices are intended to be resealable following each use.

U.S. Pat. Nos. 3,325,064; 4,277,004; and 4,440,325 disclose aerosol valve dispensers which contain detent structures that permit the valve to be initially opened and held in such open condition, either momentarily or else continuously, in the latter case it being desired to dispense completely the contents of the container. U.S. Pat. No. 3,804,302 relates to an aerosol valve having a safety mechanism permitting venting of residual gas from the container after its contents have been exhausted.

As noted in U.S. Pat. No. 4,424,918, there exist applications which dictate the use of a dispenser that cannot be resealed after initial use. The example cited is the case where two different substances are mixed together in a container, and which result in generation of gas that must be vented in order to avoid possible undesirable pressure build-up in the container.

It is believed that there exists a need for a relatively simple non-resealable cap which can be readily produced and which is low in manufacturing cost.

SUMMARY OF THE INVENTION

Accordingly it is an object of the present invention to provide a novel and improved push-to-open dispensing cap construction which is extremely simple in its structure, and which effectively resists attempts to re-seal it following initial use.

A related object of the invention is to provide an improved push-to-open dispensing cap construction as above set forth, which is easy to use. In particular, a simple "twist, then push-to-open" motion is employed to initially access the contents, after which the cap cannot be re-sealed.

A still further object of the invention is to provide an improved push-to-open dispensing cap construction of the kind indicated, which is especially reliable, and resistant to inadvertent leakage during storage or shipping.

A still further object of the invention is to provide an improved push-to-open dispensing cap construction in accordance with the foregoing, wherein the individual parts can be readily molded and thereafter assembled with a minimum of time and effort.

In accomplishing the above objects the invention provides a push-to-open, non-resealable cap construction for hand-held dispensers, comprising a body member having a discharge passage, and a nozzle member carried by the body member and being axially shiftable thereon between a raised, sealing position and a lowered, discharge position. There is a discharge orifice in the nozzle member. Valving means on the members interrupts communication between the discharge passage and the discharge orifice when the nozzle member is disposed in its raised, sealing position, and establishes communication between the discharge passage and the discharge orifice when the nozzle member is disposed in its lowered, discharging position such that product can flow through the discharge passage and valving means and out through the discharge orifice of the nozzle member. There are further provided cooperable yieldable detent means on the body member and nozzle member, for maintaining the nozzle member in the raised, sealing position in the absence of an external axial force applied to the nozzle member, but which yields under the application of an axial force applied to the nozzle member to enable the nozzle member to be shifted from its raised, sealing position to its lowered, discharge position. The yieldable detent means thereafter serves to retain the nozzle member in the lowered, discharge position once it has arrived there, thus providing a non-resealable feature.

Other features and advantages will hereinafter appear.

DESCRIPTION OF THE PREFERRED EMBODIMENT

Figure 2:
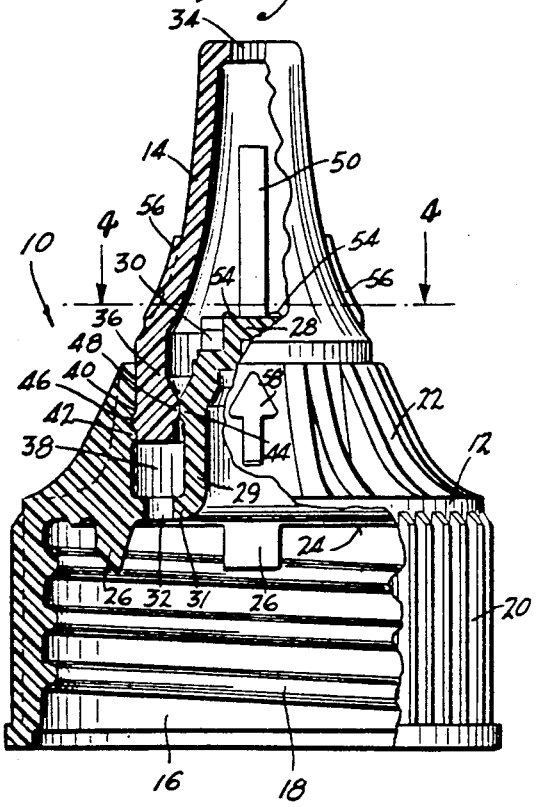
FIG. 2 is a front view, partly in elevation and partly in vertical section, of the cap construction of FIG. 1, illustrating a body member and a nozzle member carried thereby, the nozzle member occupying a raised, sealing position on the body member.
Figure 3:
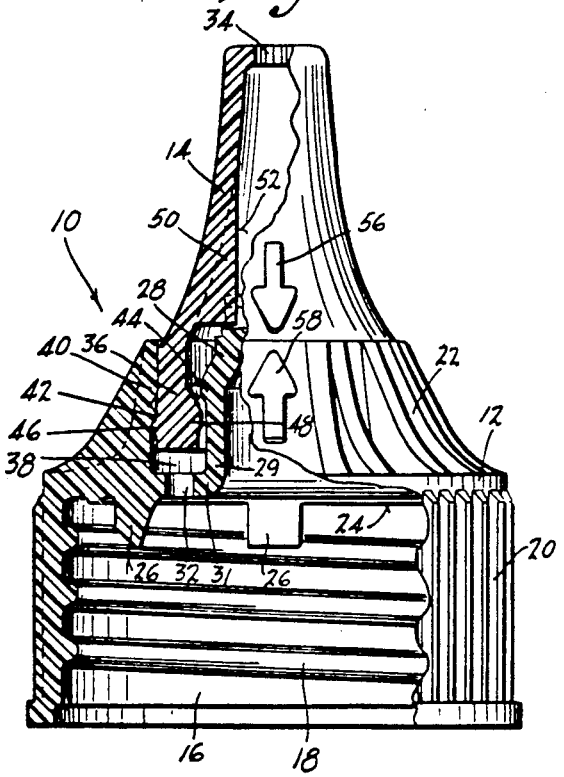
FIG. 3 is a view like FIG. 2, except with the nozzle member occupying a lowered, discharge position with respect to the body member.

Referring first to FIGS. 2 and 3, there is illustrated a cap construction generally designated by the numeral 10, comprising a body member 12 and a nozzle member 14. The body member 12 has an annular depending skirt 16 provided with internal threads 18 adapted to engage cooperable threads on the neck of a bottle or other container (not shown). The outer surface of the skirt 16 preferably has multiple integrally formed longitudinal stiffening ribs 20, and the body member 12 has additional integrally formed stiffening ribs 22, which have a generally triangular configuration.

The underside of the body member has a sealing bead 24 adapted to engage and seal with the lip of the container, and positioning lugs 26 which function to guide the body member 12 onto the lip, during assembly. The body member 12 has an upstanding dome 28 with a generally rectangular cut-out or notch 30 offset from the center of the dome, the purpose of which will be described. The dome 28 has an annular wall 29. The body member further has a top wall 31 with a series of discharge passages 32, one of which is illustrated in FIGS. 2 and 3. Preferably multiple passages 32 are disposed circumferentially around the wall 31 of the body member in the manner of the one passage illustrated.

The nozzle member 14 is hollow and has a discharge orifice 34 at its uppermost end, and a depending annular skirt 36 at the end opposite to the orifice 34. The walls of the discharge orifice 34 are shown as being of scalloped configuration.

In accordance with the present invention, the skirt 36 of the nozzle member is received in an annular upwardly facing well 38 formed in the body member 12, and cooperable detent and valving structures are provided on both the body and nozzle members for effecting a non-resealable, push-to-open function. FIG. 2 illustrates the nozzle member 14 in a raised, sealing position on the body member 12, whereas FIG. 3 illustrates a lowered, discharge position of the nozzle member 14. The well 38 and dome 28 share the common wall 29.

By the invention, there is provided on the outer wall of the annular well 38, a pair of shoulders in the form of annular beads designated 40 and 42, FIGS. 2 and 3, forming therebetween an annular groove. On the inner wall which forms the well 38 there is an annular bead 44, constituting part of a valving means to be described. Disposed on the outer surface of the skirt 36 of the nozzle member 14 is a shoulder in the form of an annular bead 46, with a second annular bead 48 formed on the inner surface of the skirt, such second bead forming another part of the valving means mentioned above.

Figure 1:
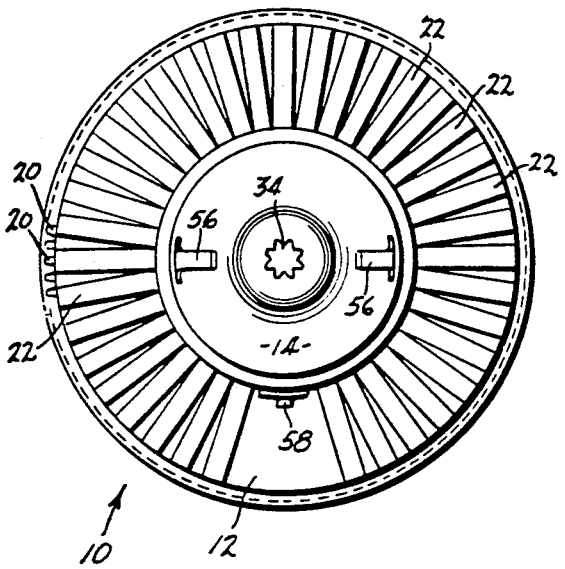
FIG. 1 is a top plan view of the improved push-to-open, non-resealable dispenser cap construction of the invention.
Figure 4:
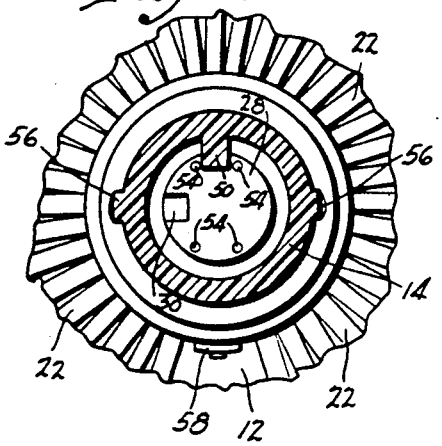
FIG. 4 is a section taken on the line 4—4 of FIG. 2.

Also by the invention, there is integrally formed on the inner surface of the nozzle member a longitudinal, tapered rib 50, shown in FIGS. 2–4. The rib 50 constitutes a blocking abutment means, and extends from the wall of the nozzle member 14 radially inward by an extent sufficient to interfere with and normally engage and register with a cooperable abutment means comprising the upper surface of the dome 28 of the body member 12 when the nozzle member 14 occupies the raised position of FIGS. 2 and 4. The inner vertical surface 52 of the rib is substantially parallel to the axis of the nozzle member 14, as shown in FIG. 3. Preferably there are provided on the upper surface of the dome 28, a plurality of positioning nibs or projections 54 two of which normally border or confine the rib 50 as in FIG. 4, and which prevent inadvertent relative rotation between the nozzle member 14 and body member 12. In FIG. 4, a total of four such nibs 54 is provided, two being disposed on opposite sides of the rib 50, with an additional two being circumferentially spaced from the first two. By such an arrangement, the nozzle member 14 can be assembled to the body member 12 in either of two diametrically opposite angular positions or orientations. For example, if the nozzle member 14 is initially positioned 180° from the showing of FIG. 4, the remaining two nibs 54 (the lowermost two nibs in FIG. 4) will border the rib 50 and resist relative turning between the nozzle member 14 and the body member 12. Integrally formed on the outer surface of the nozzle member 14 are arrows 56, preferably two in number, shown in FIG. 2, one of which is illustrated in FIG. 3 and which points downwardly in that figure. A cooperable arrow 58 is formed on the outer surface of the body member, as in FIG. 3.

With the structures described, it can be seen that from the position of FIGS. 2 and 4, the nozzle member 14 is normally blocked against downward axial movement with respect to the body member 12, as a consequence of the engagement of the rib 50 with the upper surface of the dome 28. When the cap is assembled at the factory, the rib 50 is positioned as in FIG. 4 so that such engagement with the dome surface will occur, and with the rib 50 becoming lodged between two nibs 54 as shown in FIG. 4. Under such circumstances, the arrow 58 of the body member 12 is disposed 90° from both arrows 56 on the nozzle member 14.

As noted above, FIG. 2 shows the raised, sealing position of the nozzle member 14 with respect to the body member 12, and would correspond to that occupied by the parts after the container had been filled, and the dispenser was ready for shipping. This position would also correspond to a storage condition, either in a warehouse or on the shelf of a store or market.

By the invention, the beads 48 and 44 respectively on the skirt 36 and surface of the well 38 are sealingly engaged in such raised position, and even though there is communication between the container and the well 38 through the passages 32, product cannot flow into the nozzle member interior. The external bead 46 on the skirt of the nozzle member 14 is normally received in the groove formed between the two beads 40, 42 on the wall surface of the well. The nozzle member 14 is blocked against axially downward movement which might separate the sealing or valving beads 48, 44, due to the engagement of the rib 50 and the upper surface of the dome 28.

When the consumer desires to dispense product, he or she is instructed to turn the nozzle member 14 so that one of the arrows 56 of the nozzle member 14 aligns with the arrow 58 of the body member 12 (the rib 50 riding over or by-passing one of the adjacent nibs 54) and thereafter to push the nozzle member 14 down toward the body member 12, such that the skirt 36 projects further into the well 38, as in FIG. 3. As this is done, the bead 46 by-passes the bead 42. They can be so dimensioned to provide the desired resistance to downward movement. This resistance can be substantial, since the consumer is normally capable of applying a moderate downward, pushing force on the nozzle member 14. The nature of the movement just referred to is a "first turn, then push-to-open" sequence. Once having arrived at the position of FIG. 3, the valving beads 48, 44 are seen to have become separated axially by a distance which is sufficient to establish communication between the passage 32 and well 38 on the one hand, and the interior of the nozzle member 14 on the other hand, whereby product can ultimately flow out the discharge orifice 34 when the cap and container are inverted. FIG. 4 shows the angular orientation of the nozzle member 14 with respect to the body member 12 with the rib 50 being out of alignment with the notch 30. After the consumer has turned the nozzle member 14 to a second angular orientation with respect to the body member 12, wherein one of the arrows 56 aligns with the arrow 58, the rib 50 will overlie the notch 30 and permit the nozzle member 14 to be forcibly shifted downwardly, with respect to the body member 12.

By the invention, the bead 46 is so constructed as to be capable of underlying the bead 42 with sufficient snugness in the fit so as to resist any tendency for the nozzle member 14 to be manually shifted or pulled upward toward the original sealed position of FIG. 2.

The provision of a relatively smooth, tapered exterior surface of the nozzle member 14 renders the latter difficult for the consumer to grip, and this factor, together with the snugness of the fit between the interfering beads 46, 42, results in a sufficient degree of difficulty to the end that the nozzle member 14 is rendered immovable, and the cap construction is thus considered non-resealable.

The beads 40, 42 and 46, preferably being annular, also operate to provide a seal between the skirt 36 and the outer wall of the well 38, for both the raised, sealing position of the nozzle member 14, and for the lowered, discharge position thereof, as can be readily understood. Thus, leakage of product between the skirt and outer wall of the well is eliminated, and product flow is confined to the area between the valving beads 48 and 44 when the nozzle member 14 is disposed in its lowered discharge position.

It is to be emphasized that it is more difficult to grip and pull outwardly on the nozzle member 14 than it is to push inwardly on it, due to the relatively "slippery" smooth, tapered surface of the nozzle member 14. This results in the inability to effect a reverse by-pass of the beads 46, 42, to their original positions, by means of such a pulling force applied to the nozzle member 14.

As illustrated in FIG. 3, during the discharge of product, the rib 50 remains in the notch 30 in the dome 28 of the body member 12. It is noted that there exists sufficient flow area in the vicinity of the rib 50 and in the space in the interior of the hollow nozzle member 14 particularly in front of and to the rear of the rib 50, so that little or no resistance to flow is encountered.

The rib 50 and notch 30 constitute a keying means which blocks relative turning between the nozzle member 14 and the body member 12 when the nozzle member 14 is disposed in its lowered, discharge position. This enhances the non-resealable characteristic since in such lowered, discharge position, the nozzle member 14 cannot be turned while being pulled, as is often attempted when it is desired to separate two interfitting parts. Thus, the arrangement of the rib and notch further frustrates such attempts to re-seal the nozzle member 14.

The provision of a scalloped surface at the discharge orifice 34 prevents the use of a simple plug to re-seal the container. A rigid plug of cylindrical configuration would not fill the spaces of the scalloped walls, thus preserving the non-reseal feature. Nor would a plug constituted of soft material such as cloth or cotton, result in pressure-tight re-sealing characteristics.

From the above it can be seen that I have provided a novel and improved non-resealable push-to-open dispenser cap construction which is both simple in its structure and reliable in use. It is especially well suited to applications where re-seal of a dispenser is to be prevented. The device is easy to use, and low cost. The illustrated embodiment can be readily fabricated as two separate pieces, with all components of each piece being integrally molded.

The device is thus seen to represent a distinct advance and improvement in the field of dispensing caps.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A push-to-open, non-resealable cap construction for hand-held dispensers, comprising in combination:

a) a body member having a discharge passage, b) a nozzle member carried by the body member and being axially shiftable thereon between a raised, sealing position and a lowered, discharge position, said nozzle member having a discharge orifice, c) cooperable valving means on said members for interrupting communication between the discharge passage and the discharge orifice when the nozzle member is disposed in its raised, sealing position, and for establishing communication between the discharge passage and the discharge orifice when the nozzle member is disposed in its lowered, discharging position such that product can flow through the discharge passage and valving means and out through the discharge orifice of the nozzle member, and d) cooperable yieldable detent means on said body member and nozzle member, for maintaining said nozzle member in the raised, sealing position in the absence of an external axial force applied to the nozzle member, said yieldable detent means yielding under the application of an axial force applied to the nozzle member to enable the nozzle member to be shifted from its raised, sealing position to its lowered, discharge position, said yieldable detent means thereafter serving to retain said nozzle member in said lowered, discharge position once it has arrived there.

2. The invention as set forth in claim 1, wherein:

a) said cooperable valving means comprises an annular sealing bead on the body member, and an annular sealing bead on the nozzle member, said nozzle member bead being movable axially of the body member bead as the nozzle member moves.

3. The invention as set forth in claim 1, wherein:

a) said yieldable detent means comprises a shoulder on the nozzle member, and a cooperable shoulder on the body member, b) said shoulders being adapted to by-pass one another when the nozzle member is shifted from its raised sealing position to its lowered discharge position.

4. The invention as set forth in claim 1, and further including:

a) cooperable blocking abutment means on said body member and on said nozzle member, for positively retaining the latter in its raised sealing position for a given predetermined angular orientation between said members, said blocking abutment means being rendered inoperative for a second predetermined angular orientation between said members.

5. The invention as set forth in claim 4, and further including:

a) indicator means on said nozzle member, for designating the arrival of said nozzle member at said second predetermined angular orientation.

6. The invention as set forth in claim 4, wherein:

a) said nozzle member has an internal passage communicating with said discharge orifice, b) said abutment means comprising an inwardly projecting rib in said internal passage, and c) means defining an upstanding dome on the body member, said dome having an upper surface adapted to be engaged by said rib.

7. The invention as set forth in claim 6, wherein:

a) said upstanding dome has a notch in its surface, adapted to receive the said rib of the nozzle member when the latter is disposed in a predetermined angular position with respect to the body member.

8. The invention as set forth in claim 1, wherein:

a) said discharge orifice has a scalloped wall surface configuration.

9. The invention as set forth in claim 1, wherein:

a) said nozzle member has a substantially smooth, exterior surface configuration that resists gripping and the application of pulling forces to the nozzle member.

10. A push-to-open, non-resealable cap construction for hand-held dispensers, comprising in combination:

a) a body member having a discharge passage, b) a nozzle member carried by said body member and being axially shiftable thereon between a raised, sealing position and a lowered, discharge position, said nozzle member having a discharge orifice, c) said body member having an annular well, and said nozzle member having a depending annular skirt occupying said well, and d) cooperable valving means on a wall of the well and on the skirt, for interrupting communication between the discharge passage and the discharge orifice when the nozzle member is disposed in its raised, sealing position, and for establishing communication between the discharge passage and the discharge orifice when the nozzle member is disposed in its lowered, discharging position such that product can flow through the discharge passage and into the well, through the valving means and out through the discharge orifice of the nozzle member.

11. The invention as set forth in claim 10, wherein:

a) said cooperable valving means comprises a substantially annular bead on the said wall of the well, and b) a substantially annular cooperable bead on the skirt of the nozzle member, said beads sealingly engaging one another when the nozzle member is disposed in its raised sealing position.

12. The invention as set forth in claim 10, wherein:

a) said well has a bottom wall, b) said discharge passage being disposed in said bottom wall.

13. The invention as set forth in claim 10, wherein:

a) said well has an inner wall, b) said valving means comprising a shoulder on said inner wall, and a cooperable shoulder on the skirt of the nozzle member.

14. The invention as set forth in claim 10, and further including:

a) cooperable detent shoulders on a wall of the well and on the skirt, respectively, said shoulders normally retaining the nozzle member in its raised, sealing position, b) said shoulders by-passing one another when the nozzle member is shifted from its raised sealing position to its lowered discharge position.

15. The invention as set forth in claim 14, wherein:

a) said shoulders retain said nozzle member in said lowered discharge position after the nozzle member has arrived at said position.

16. The invention as set forth in claim 10, and further including:

a) cooperable blocking abutment means on said body member and on said nozzle member, for positively retaining the latter in its raised sealing position for a given predetermined angular orientation between said members, said blocking abutment means being rendered inoperative for a second predetermined angular orientation between said members.

17. The invention as set forth in claim 16, and further including:

a) indicator means on said nozzle member, for designating the arrival of said nozzle member at said second predetermined angular orientation.

18. The invention as set forth in claim 16, wherein:

a) said nozzle member has an internal passage communicating with said discharge orifice, b) said abutment means comprising an inwardly projecting rib in said internal passage, and c) means defining an upstanding dome on the body member, said dome having an upper surface adapted to be engaged by said rib.

19. The invention as set forth in claim 18, wherein:

a) said upstanding dome has a notch in its surface, adapted to receive the said rib of the nozzle member when the members are disposed in said second predetermined angular orientation.

20. The invention as set forth in claim 18, wherein:

a) said dome and said well have a common annular wall.

21. The invention as set forth in claim 10, wherein:

a) said cooperable valving means is disposed on the inner wall of the well and on the inner wall of the skirt, and further including, b) cooperable sealing means on the outer wall of the well and the outer wall of the skirt, preventing leakage of product between said outer well wall and outer skirt wall for both the raised, sealing position of the nozzle member, and the lowered, discharge position thereof.

22. The invention as set forth in claim 1, and further including:

a) cooperable keying means on said members, for enabling the nozzle member to be manually turned with respect to the body member when the nozzle member is disposed in its raised, sealing position, and for blocking the nozzle member against turning with respect to the body member, when the nozzle member is disposed in its lowered, discharge position.

23. A push-to-open, non-resealable cap construction for hand-held dispensers, comprising in combination:

a) a body member having a discharge passage, b) a nozzle member carried by the body member and being manually axially shiftable thereon between a raised, sealing position and a lowered, discharge position, said nozzle member having a discharge orifice, c) cooperable abutment means on the body member and nozzle member, for normally blocking the nozzle member against movement from its raised, sealing position, toward its lowered discharge position, said abutment means being rendered inoperative in response to turning of the nozzle member with respect to the body member to a predetermined angular position relative to said body member thus moving said abutment means out of cooperation to enable the nozzle member to be manually shifted axially from its raised, sealing position toward its lowered, discharge position establishing communication between said body member discharge passage and nozzle member discharge orifice.

24. A push-to-open, non-resealable cap construction for hand-held dispensers, comprising in combination:

a) a body member having a discharge passage, b) a nozzle member carried by the body member and being axially shiftable thereon between a raised, sealing position and a lowered, discharge position, said nozzle member having a discharge orifice, c) cooperable registerable abutment means on the body member and nozzle member, for normally blocking the nozzle member against movement from its raised, sealing position, toward its lowered discharge position when said means are in registration, said abutment means being shifted out of registration and rendered inoperative in response to turning of the nozzle member with respect to the body member to a predetermined angular position that enables the nozzle member to be shifted axially toward its lowered, discharge position.

* * * * *